US005829921A

United States Patent [19]

Krings

[11] Patent Number: 5,829,921

[45] Date of Patent: Nov. 3, 1998

[54] TRENCH FALSEWORK PANEL

[75] Inventor: Josef Krings, Heinsberg, Germany

[73] Assignee: Wolfgang Richter, Hurtgenwald, Germany

[21] Appl. No.: 809,015

[22] PCT Filed: Aug. 4, 1995

[86] PCT No.: PCT/DE95/01043

§ 371 Date: May 8, 1997

§ 102(e) Date: May 8, 1997

[87] PCT Pub. No.: WO96/08608

PCT Pub. Date: Mar. 21, 1996

[30] Foreign Application Priority Data

Sep. 12, 1994 [DE] Germany ..... 44 32 320.4

[51] Int. Cl.[6] ..... E02D 3/02

[52] U.S. Cl. ..... 405/282; 405/283

[58] Field of Search ..... 405/282, 283, 405/272; 52/122.1, 124.1, 124.2, 125.3, 125.6

[56] References Cited

U.S. PATENT DOCUMENTS

| | | | |
|---|---|---|---|
| 2,886,370 | 5/1959 | Liebert | 52/125.3 X |
| 3,347,049 | 10/1967 | Faltersack et al. . | |
| 3,593,528 | 7/1971 | Pavese . | |
| 4,056,938 | 11/1977 | Griswold . | |
| 4,345,857 | 8/1982 | Krings | 405/282 |
| 5,277,522 | 1/1994 | Pertz | 405/283 |
| 5,503,504 | 4/1996 | Hess et al. | 405/282 |

FOREIGN PATENT DOCUMENTS

| | | | |
|---|---|---|---|
| 26 24 954 A1 | 12/1977 | Germany . | |
| 30 15 110 A1 | 10/1981 | Germany . | |
| 42 09 675 C1 | 7/1993 | Germany . | |
| 2094373 | 9/1981 | United Kingdom | 405/282 |

*Primary Examiner*—Tamara L. Graysay
*Assistant Examiner*—Jong-Suk Lee
*Attorney, Agent, or Firm*—Kennedy Covington Lobdell & Hickman, LLP

[57] ABSTRACT

The invention concerns a panel for use in trench falsework as part of a box construction or in sliding forms in civil-engineering. The falsework is easy to mount in place and is resistant to buckling, even along the triangular hollow section which forms the cutting edge at the bottom of the panel, by virtue of the fact that the triangular hollow section incorporates single-piece steel suspension rings which have a partly rounded and partly straight outside circumference. The outside shape of the rings fits into the surface of the metal sheet surrounding the ring, the straight part of the rings forming part of the cutting edge and the rounded part of the rings being welded to the adjacent parts of the hollow section.

6 Claims, 1 Drawing Sheet

TRENCH FALSEWORK PANEL

BACKGROUND OF THE INVENTION

The invention relates to a lining plate, consisting of profiled sheet metal elements enclosed between two rectangular sheet metal covers and circumferential hollow profiles welded to the sheet metal covers, to be used in connection with trench lining in below-grade construction.

A lining plate with a circumferential hollow profile is described in DE 30 15 110 A1. This lining plate, also provided for shoring up trench walls, has exterior sheet metal plates essentially extending over the entire plate surface, a rectangular frame supporting the edges of the exterior sheet metal plates, and profiles which reinforce the frame and intersect each other. Together with the exterior sheet metal plates, the frame profiles constitute closed hollow box profiles, i.e. a plate frame delimiting the plate body. In detail, the latter can consist of an upper anvil cross piece (pressure cross beam), on which pressure or blows are directed during operation; of lateral closing profiles (vertical cross beams) which can have a rectangular cross section, the same as the anvil profiles; and of a lower pointed or cutting profile of triangular cross section.

In the course of assembling a lining box of two lining plates, generally the one lining plate is placed on the ground, then braces (these are spacers between lining plates standing opposite each other in the trench) are fastened in the plate resting on the ground; the second plate is then lifted over the first plate by a crane and the braces are inserted from below into the second plate and fastened there. During this operation it is necessary for the second plate to be accurately directed by the crane and securely held, so that no accidents can occur. The assembly is furthermore made considerably easier if the plates are hung horizontally, since there will be no jamming when the spindle is inserted. To this end, in actual operations the exterior narrow sides of the two lateral closing profiles of the plate are pulled forward as "free" triangular sheet metal brackets up to approximately the tip of the cutting edge of the lower profile and are equipped with a suspension hole. During horizontal directing the crane can act on the two triangular brackets and further attachment points associated with the upper plate edge, i.e. at four points.

The drilled brackets provided laterally at the longitudinal ends of the cutting edge are generally bent after a short period of use, or even broken off. In actual use the lining plate is therefore held at the cutting edge during assembly in that the crane hooks are simply placed over the cutting edge—without a particular attachment point. Then there is always the danger that one or the other hook slides to the side when the plate is lifted, so that the entire plate begins to tilt.

SUMMARY OF THE INVENTION

It is the object of the invention to provide a fastening possibility as the attachment means for a crane hook, a cable or the like at the pointed or lower edge or cutting edge of the lining plate, in particular for suspending the lining plate in a horizontal position, by means of which neither the driving of the lining plate into the ground is hampered nor the cutting edge of the lining plate, embodied as a hollow profile, is weakened against torsional buckling or the like, and which cannot be damaged, even by driving the lining plate into the ground or pulling the lining plate further along the trench. In addition, the novel fastening or attachment means is intended to permit the direct engagement of a crane hook, similar to the conventional triangular brackets provided on the longitudinal ends of the cutting edge.

The attainment of the object in accordance with the invention lies in that the pointed hollow profile constituting the cutting edge of the lower plate edge contains at least one massive suspension ring made of steel of a cross section which is at least approximately congruent with the triangular cross section of the cutting edge and with a partially straight and otherwise approximately semicircular exterior circumference, whose rounded area is welded all around to the pointed hollow profile, and whose straight area forms a part of the lower plate edge.

Thus, in accordance with the invention a massive ring—preferably consisting of cast steel or forged steel—is inserted into the tip or cutting edge of the lining plate which is embodied as a hollow profile, whose exterior contour on the one hand exactly fits the surface of the cover surfaces surrounding the ring and, on the other hand, constitutes a part of the cutting edge as well as its edge itself.

The suspension ring in accordance with the invention is situated inside the hollow profile frame reinforcing the lining plate, but the ring does not weaken the frame, since because of its massive design its inherent stiffness is at least as great as the stiffness of the sheet steel which must be cut out of the hollow profile for inserting the ring, and since it becomes a part of the hollow profile because of the all around welding with the remaining hollow profile elements.

An essential advantage of the suspension ring in accordance with the invention lies in that the ring opening can lie close enough to the cutting edge that a crane hook—if necessary with a hook safety device—can grip over the bar remaining between the cutting edge and the opening. Maximum safety is provided for possible assembly work by means of this, for example in connection with a lining box. An advantage of the attainment of the object in accordance with the invention connected with this lies in that the suspension ring installed in the cutting edge can resist the forces acting in the course of driving it into the ground at least as well as the remaining parts of the cutting edge, and that when pulling the lining plate along in the longitudinal direction of the trench, the suspension ring is neither subjected to an additional load nor does it hamper the forward pulling of the plate, so that it acts like a part of the remaining cutting edge during operation.

Details of the invention will be explained by means of the schematic representation of an exemplary embodiment shown in the accompanying drawings.

DESCRIPTION OF THE PREFERRED EMBODIMENT

Figure 1:
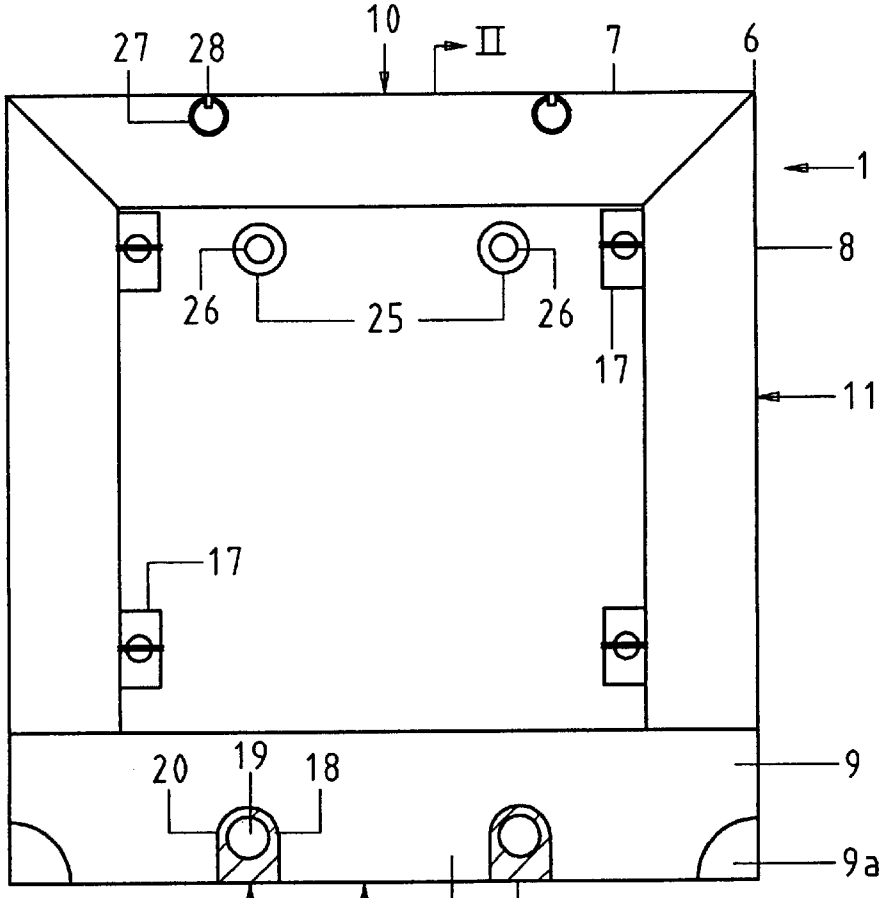
FIG. 1 is a view of the inside (side facing inside the trench) of a lining plate.

In the accompanying drawings and in the following description thereof, the reference numerals in the drawings identify components of the present invention as indicated below:

| List of Reference Numerals | |
|---|---|
| 1 | Lining plate |
| 2 | Inner sheet metal cover |
| 3 | Outer sheet metal cover |
| 4 | Profiled sheet metal element |
| 5 | Rectangular frame construction |
| 6 | Frame corner |
| 7 | Upper hollow profile |
| 8 | Lateral hollow profile |
| 9 | Pointed hollow profile |
| 9a | Longitudinal ends |
| 10 | Upper plate edge |
| 11 | Lateral plate edge |
| 12 | Cutting edge |
| 13 | Lower plate edge |
| 14,15 | Cathetus |
| 16 | Hypotenuse |
| 17 | Receptacle housing |
| 18 | Suspension ring |
| 19 | Opening (18) |
| 20 | Rounded area (18) |
| 21 | Straight area (18) |
| 22,23 | Axial surfaces (18) |
| 24 | Bar (18) |
| 25 | Suspension eye |
| 26 | Attachment means |
| 27 | Hoisting ring |
| 28 | Eye (27) |

Figure 2:
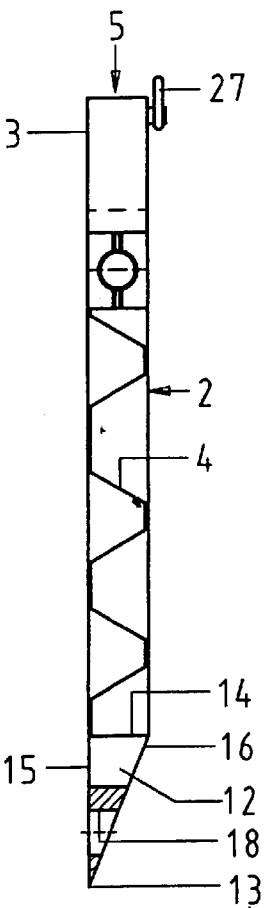
FIG. 2 is a sectional view of a lining box of two lining plates in FIG. 1, approximately along the section II—II in FIG. 1.

The lining plate represented in FIGS. 1 and 2, identified as a whole by 1, consists of two rectangular sheet metal covers 2 and 3 with profiled sheet metal elements 4 enclosed between them and a circumferential hollow profile frame 5 welded to the cover surfaces 2 and 3, which as a whole is identified as the rectangular frame structure 5 and consists of respectively one hollow profile 7, 8 or 9 uninterruptedly extending from frame corner 6 to frame corner 6. The ends of the hollow profiles 7 to 9 meeting at the frame comers 6 are welded together in such a way that the rectangular frame construction 5 acts as one piece. The hollow profiles 7 to 9 can be longitudinally welded or seamlessly welded or drawn. Preferably these are not only U- or C-profiles, but hollow profiles closed in a tube-like manner. In detail the frame structure 5 in accordance with FIG. 1 consists of a pressure cross beam 7 particularly stabilized against flexural bucking at the upper plate edge 10, of respectively one vertical cross beam 8 especially stabilized against forces in the vertical longitudinal direction at the plate sides 11, and a pointed hollow profile 9 having a cutting edge 12 on the lower plate edge 13, whose longitudinal ends 9*a* are suitably embodied especially advantageously, particularly massively, where they adjoin the lower edge 13. While the pressure cross beam 7 and the vertical cross beam 8 are intended to have a rectangular cross section, the pointed hollow profile of the lower edge 13 has an cross section approximately in the form of a right triangle, whose one cathetus 14 lies vertically in respect to the plane of the rear wall 2, 3, whose other cathetus 15 lies in the plane of the exterior cover surface 3 which, during lining, faces the soil, and whose hypotenuse 16 is intended to face the interior of the trench. If required, receptacle housings 17 provided for placing and fastening braces (not shown) in place are inserted with the opening at the sheet metal cover 2, which is on the inside during lining, into the lining plate 1 adjoining or adjacent to the hollow profiles 8.

Figure 3:
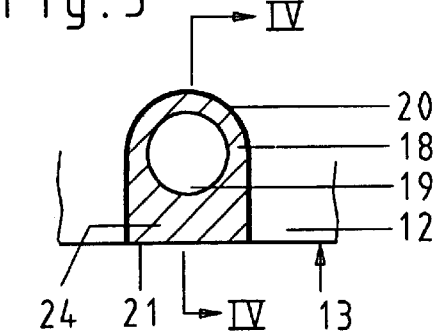
FIG. 3 is an enlarged representation of the section through a shoe support housing with support shoe in FIG. 2.
Figure 4:
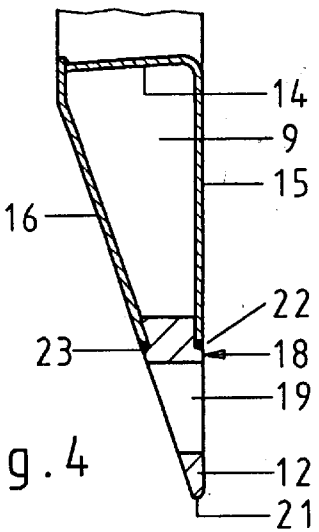
FIG. 4 is a section along the line IV—IV in FIG. 3.

In accordance with the invention at least one suspension ring 18 is integrated with a suspension opening 19 into the cutting edge 12 adjoining the lower edge 13 of the pointed hollow profile 9. The suspension ring 18 has a rounded circumferential area 20 and a straight circumferential area 21 situated parallel with a tangent of the opening 19. Details are shown in enlargement in FIGS. 3 and 4. It is important among other things that the suspension ring 18 has a cross section which is congruent with the triangular cross section of the cutting edge 12. FIG. 4 shows the cross section of the pointed hollow profile 9 and therefore also the cross section of the cutting edge 12 and the suspension ring 18 integrated therein by welding, that the axial surfaces 22 and 23 of the suspension ring 18, which are placed obliquely in relation to each other, the same as the cutting edge surfaces 15, 16, are fitted as exactly a possible into the two surfaces, defined by the cathetus 15 and the hypotenuse 16, of the pointed hollow profile 9.

The suspension ring 18 has a bar 24 essentially extending parallel with the lower plate edge 13 between the straight circumferential area 21 and the opening 19. It preferably is designed in such a way that it is simultaneously sufficiently strong or voluminous to be as stable against buckling or breaking as the remaining part of the lower cutting edge 12, and yet slim enough to assure the direct suspension and the overlapping securing of a crane hook or like hoisting means. A hook safety is envisioned in connection with overlapping securing which in the course of suspending the hook is placed around the bar as a continuation of the hook point, as it were.

If the lining plate 1 is to be directed approximately horizontally during assembly, the crane can take hold, for example with a cable or hook, directly in the opening 19 of the suspension ring 18. With its safety the hook can reach around the lower bar 24 adjoining the lower plate edge 13, since the opening 19 is intended to lie correspondingly close to the cutting edge 12. If it is intended to lift the plate horizontally with the aid of the two suspension rings 18 in FIG. 1, the lifting means also need to act on at least one other place of the lining plate 1. To this end, in accordance with the exemplary embodiment, suspension eyes 25 with built-in attachment means 26 (for crane hoisting means or the like) are provided approximately in the upper third of the surface of the lining plate, but at a distance away from the adjoining hollow profiles 7 and 8. In place of this it is also possible for hoisting rings 27 to be welded with the aid of eyes 28 to an upper part of the frame 5, in particular on the hollow profile 7. The hoisting means of the crane can, among other things, also act on correspondingly designed attachment points of the receptacle housing 17.

A lining plate intended for employment in connection with trench lining in below-ground construction as a component of a lining box, or with sliding rail lining, becomes assembly-friendly and remains secure against buckling even at its triangular hollow profile with the cutting edge, if massive suspension rings made of steel with partially straight and partially rounded exterior circumferences are inserted into the triangular hollow profile, whose axial exterior contour fits into the surface of the sheet metal cover surrounding the ring, whose straight circumferential part forms a part of the edge of the cutting edge and whose rounded circumferential part is welded together with the adjoining parts of the hollow profile.

What is claimed is:

1. A lining plate for use as a trench lining in below grade construction, the lining plate comprising profiled sheet metal elements enclosed between two rectangular sheet metal covers and peripheral hollow profiles welded to the sheet metal covers, wherein one of the hollow profiles comprises a lower cutting edge having a triangular cross-section defining a pointed lower plate edge and at least one massive metal suspension ring having a cross section which is at least approximately congruent with the triangular cross section of the lower cutting edge and having an exterior shape with a partially straight portion forming a part of the lower plate edge and an approximately semicircular portion welded thereabout to the one hollow profile.

2. The lining plate in accordance with claim 1, wherein the suspension ring defines an opening therethrough and comprises a bar between the opening and the lower plate edge, the bar being at least as resistant to buckling as the remainder of the lower cutting edge and permitting the direct suspension and securing of a hoisting means.

3. The lining plate in accordance with claim 1 or 2, wherein the suspension ring is made of steel.

4. A lining plate for use as a trench lining in below grade construction, the lining plate comprising a plate body having a lower cutting edge of a triangular cross section defining a pointed lower plate edge and at least one massive suspension ring of a cross section which is at least approximately congruent with the triangular cross section of the lower cutting edge and having an exterior shape with a partially straight portion forming a part of the lower plate edge and an approximately semicircular portion welded thereabout to the lower cutting edge.

5. The lining plate in accordance with claim 4, wherein the suspension ring defines an opening therethrough and comprises a bar between the opening and the lower plate edge, the bar being at least as resistant to buckling as the remainder of the lower cutting edge and permitting the direct suspension and securing of a hoisting means.

6. The lining plate in accordance with claim 4 or 5, wherein the suspension ring is made of steel.

* * * * *